US009506658B2

(12) United States Patent
Kwag et al.

(10) Patent No.: US 9,506,658 B2
(45) Date of Patent: Nov. 29, 2016

(54) COOKER

(75) Inventors: Dongseong Kwag, Seoul (KR); Yangkyeong Kim, Seoul (KR); Hyunjung Kim, Seoul (KR); Changhyun Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1405 days.

(21) Appl. No.: 12/886,250

(22) Filed: Sep. 20, 2010

(65) Prior Publication Data

US 2011/0067684 A1 Mar. 24, 2011

(30) Foreign Application Priority Data

Sep. 21, 2009 (KR) ..... 10-2009-0088958
Jan. 19, 2010 (KR) ..... 10-2010-0004727

(51) Int. Cl.
*F24C 15/32* (2006.01)
*F24C 15/20* (2006.01)

(52) U.S. Cl.
CPC ..... *F24C 15/2007* (2013.01); *F24C 15/32* (2013.01)

(58) Field of Classification Search
CPC ..... F24C 15/2007; F24C 15/32
USPC ..... 126/15 R, 21 R; 219/757
See application file for complete search history.

(56) References Cited

U.S. PATENT DOCUMENTS 4,796,600 A * 1/1989 Hurley et al. ..... 126/273 A
6,761,159 B1 * 7/2004 Barnes et al. ..... 126/21 R

FOREIGN PATENT DOCUMENTS

KR 10-1999-017488 A 3/1999
KR 20-0244740 Y1 11/2001
KR 20-0380884 Y1 4/2005
KR 10-2006-0082723 A 7/2006
KR 10-0604487 B1 7/2006

* cited by examiner

*Primary Examiner* — William G Corboy
(74) *Attorney, Agent, or Firm* — Birch, Stewart, Kolasch & Birch, LLP

(57) ABSTRACT

The present invention relates to a cooker. In the present invention, the exhaust gas of the upper cooking chamber flows into the upper duct and discharged to the outside of the cooker and the exhaust gas of the lower cooking chamber sequentially flows into the lower duct, the upper duct and discharged to the outside of the cooker, and the exhaust gas of the upper and lower cooking chamber is discharged to the outside of the cooker alone or in a mixed state thereof. Therefore, in the present invention, the exhaust gas generated during cooking foods in the upper cooking chamber and the lower chamber may be discharged by a simpler configuration.

6 Claims, 18 Drawing Sheets

COOKER

CROSS REFERENCES RELATED APPLICATIONS

The present application claims priority under 35 U.S.C. 118B and 35 U.S.C. 365 to Korean Patent Application No. 10-2009-0088958 (filed on Sep. 21, 2009), and Korean Patent Application No. 10-2010-0004727 (filed on Jan. 19, 2010), which are hereby incorporated by reference in its entirety.

BACKGROUND OF THE INVENTION

1. Field of the Invention

The embodiment relates to a cooker.

2. Description of the Related Art

A cooker is a home appliance that cooks foods using gas or electricity. The cooker essentially requires an exhaust system for discharging exhaust gas generated during cooking foods in a cooking chamber to the outside.

SUMMARY OF THE INVENTION

An aspect of the present invention is to provide a cooker for efficiently discharging exhaust gas generated during cooking foods in at least two cooking chambers to the outside.

An another aspect of the present invention is to provide cooker with a simpler configuration.

The cooker according to the exemplary embodiments of the present invention has the following effects.

First, the present invention can more efficiently discharge the exhaust gas generated during cooking fools in at least two cooking chambers to the outside. Therefore, the cooker may be used more clearly.

Further, the present invention simply fixes the duct system for discharging the exhaust gas generated during generated during cooking fools in at least two cooking chambers to the main body of the cooker. Therefore, it is possible to simply manufacture a product.

DETAILED DESCRIPTION OF THE PREFERRED EMBODIMENTS

Hereinafter, an exhaust system according to a first exemplary embodiment of the present invention will be described in more detail with reference to the accompanying drawings.

Figure 1:
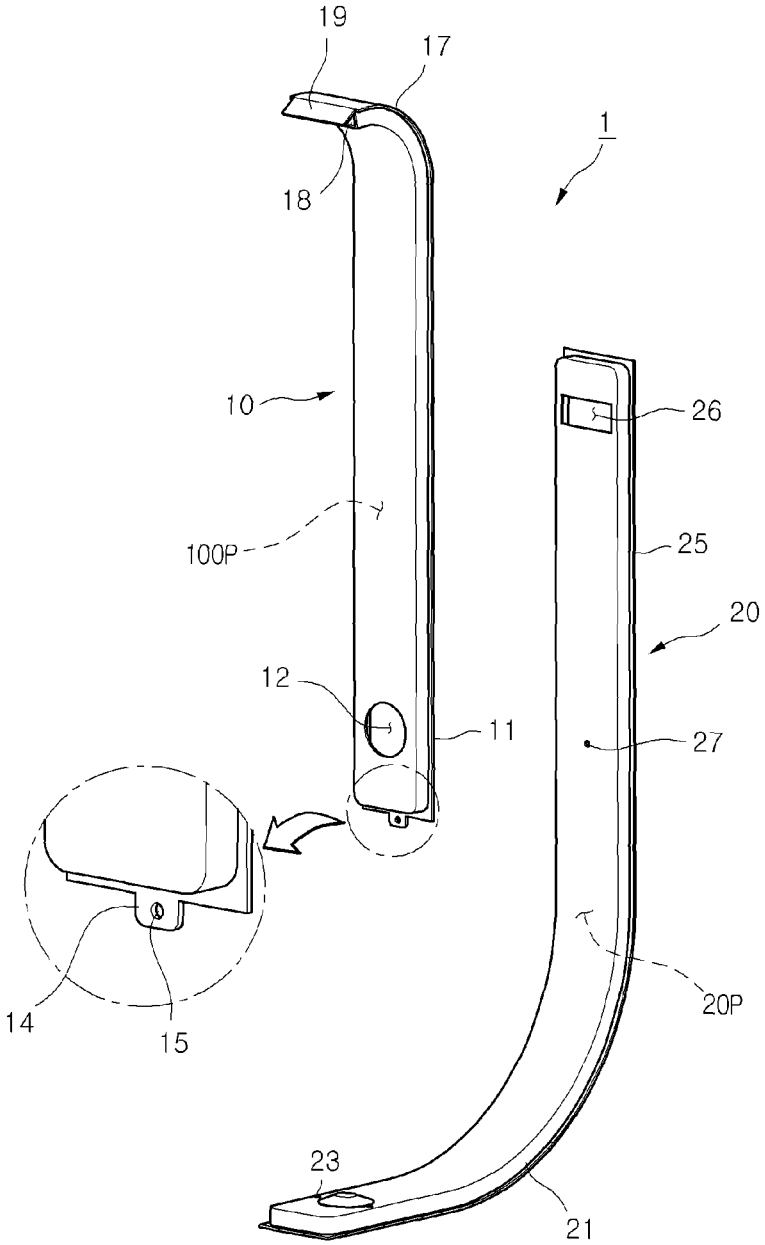
FIG. 1 is an exploded perspective view showing an exhaust system of a cooker according to a first exemplary embodiment of the present invention.
Figure 2:
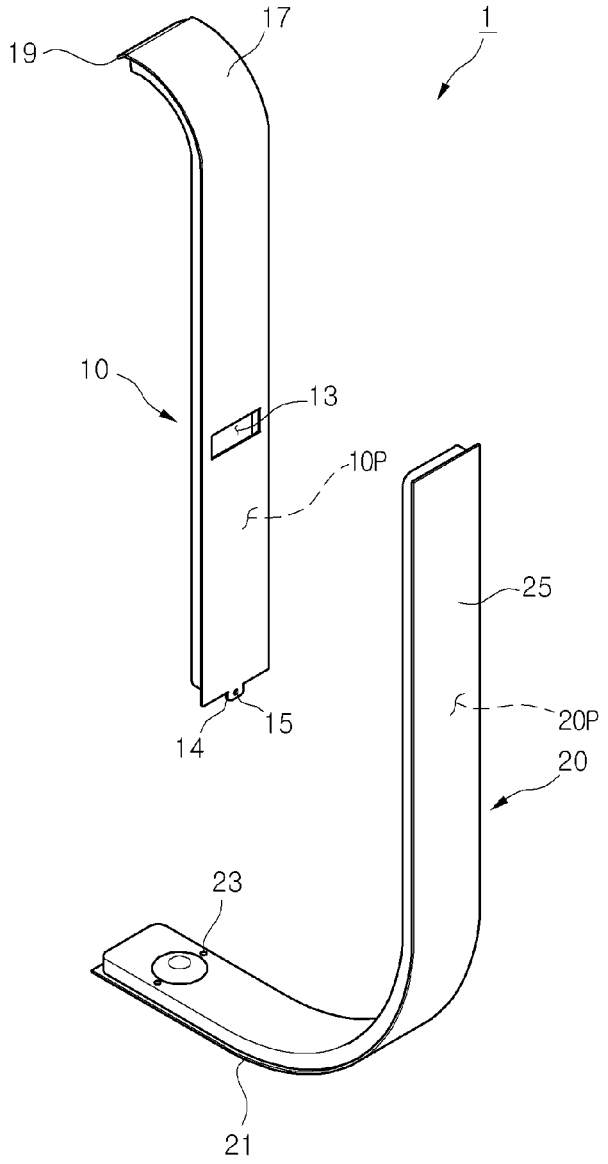
FIG. 2 is an exploded perspective view the exhaust system according to the first exemplary embodiment of the present invention viewed from another view.
Figure 3:
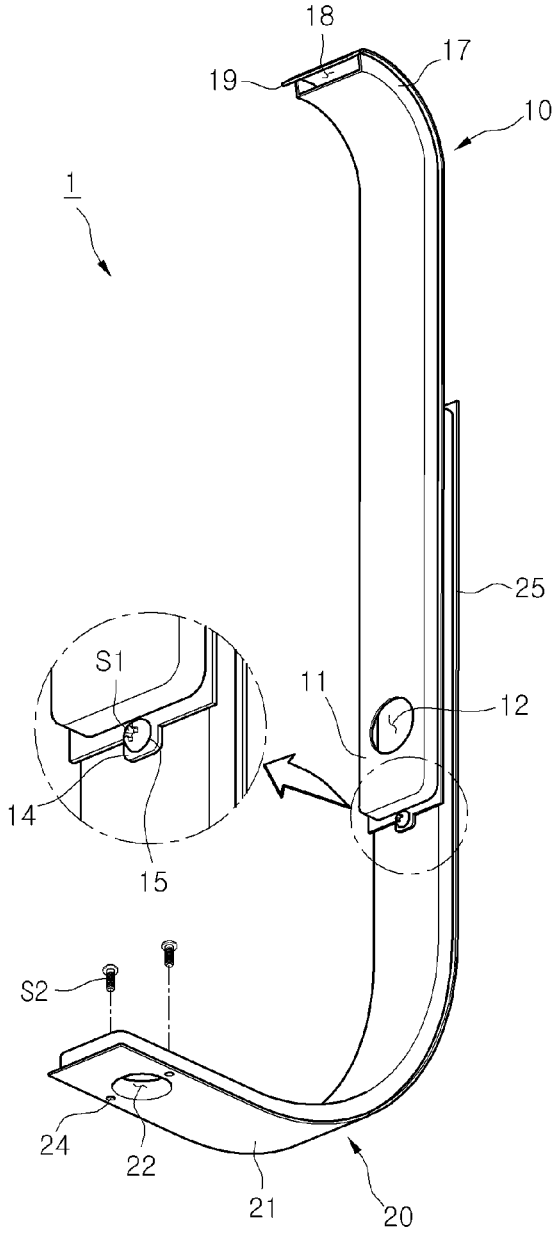
FIG. 3 is a perspective view showing a combined state of an exhaust system according to the first exemplary embodiment of the present invention.

FIG. 1 is an exploded perspective view showing an exhaust system of a cooker according to a first exemplary embodiment of the present invention, FIG. 2 is an exploded perspective view the exhaust system according to the first exemplary embodiment of the present invention viewed from another view, and FIG. 3 is a perspective view showing a combined state of an exhaust system according to the first exemplary embodiment of the present invention Referring to FIGS. 1 to 3, an exhaust system 1 includes an upper duct 10 and a lower duct 20. The upper duct 10 serves to discharge exhaust gas generated during cooking foods in an upper cooking chamber 131 (see FIG. 5) to be described later to the outside. The lower duct 20 serves to discharge exhaust gas generated during cooking foods in a lower cooking chamber 141 (see FIG. 5) to be described later to the outside.

The upper duct 10 includes an upper suction part 11 and a discharge part 17. The upper suction part 11 is lengthily formed in a length direction (approximately a vertical direction in the state where the exhaust system 1 is installed in a cooker 100 (see FIG. 5)). The discharge part 17 is bent at one end of the upper suction part 11 at a predetermined curvature. Substantially, the upper suction part 11 and the discharge part 17 may be integrally formed by bending a portion of an upper end of a tube having a predetermined length to entirely have a hook shape, The upper passage 10P is provided in the upper duct 10.

The upper suction part 11 is provided with an upper intake port 12 and a communication hole 13. The end of the discharge part 17 is provided with an external exhaust port 18. In this configuration, the upper intake port and the communication hole 13 are formed at a surface opposed to each other of the upper suction part 11. In the first exemplary embodiment, the upper intake port 12 is formed on one surface corresponding to the front surface of the upper suction part 11 and the communication hole 13 is formed on one surface corresponding to the rear surface of the upper suction part 11, in the state where the exhaust system 1 is installed in the cooker 100. The exhaust gas generated from the upper cooking chamber 131 is sucked into the upper passage 10P through the upper intake port 12. The exhaust gas generated from the lower cooking chamber 141 and flowing into the lower duct 20 is transferred into the upper passage 10P through the communication hole 13. The exhaust gas of the upper cooking chamber 131 or/and the lower cooking chamber 141 flowing into the upper passage 10P is discharged to the outside through the external exhaust port 18.

Meanwhile, the external exhaust port 18 is disposed over the upper intake port 12 and the communication hole 13 in the state where the exhaust system 1 is installed in the cooker 100. This is to discharge the exhaust gas of the upper cooking chamber 131 and the lower cooking chamber 141, which is sucked and transferred through the upper intake port 12 and the communication hole 13 and flowing into the upper passage 10P, to be discharged through the external exhaust port 18 by natural convection. In addition, the communication hole 13 is disposed at a relatively higher position than the upper intake port 12 in the state where the exhaust system 1 is installed in the cooker 100. This is to prevent the exhaust gas of the lower cooking chamber 141 transferred into the upper passage 10P through the communication hole 13 from reflowing into the upper cooking chamber 131 through the upper intake port 12.

The upper duct 100 is provided with a guide rib 19. The guide rib 19 serves to guide the exhaust gas of the upper cooking chamber 131 and/or the lower chamber 141 discharged through the external exhaust port 18. In the first exemplary embodiment, the guide rib 19 is extended to be inclined at a predetermined angle at one side of the discharge part 17 corresponding to the upper end of the external exhaust port 18. In this configuration, the guide rib 19 is extended to be downwardly inclined toward the front of the cooker 100 in order to guide the exhaust gas discharged through the external exhaust port 18 to be downwardly inclined, in the state where the exhaust system 1 is installed in the cooker 100.

The lower duct 20 includes a lower suction part 21 and a transfer part 25. The lower suction part 21 is lengthily formed in a length direction (a horizontal direction in the state where the exhaust system 1 is installed in the cooker 100). The transfer part 25 is extended to be inclined at one end of the lower suction part 21 at a predetermined angle. The lower suction part 21 and the transfer part 25 may be formed by bending one tube into approximately a L-letter shape. A lower passage 20P is provided in the inside of the lower duct 20, that is, the insides of the lower suction part 21 and the transfer part 25.

Meanwhile, the lower duct 20 is provided with a lower intake port 22 and a transfer hole 26. The lower inlet part 22 serves to suck the exhaust gas generated from the lower cooking chamber 141 into the inside of the lower duct 20, that is, the lower passage 20P. The transfer hole serves as an outlet that transfers the exhaust gas sucked through the lower intake port 22 and flows into the lower passage 20P to the upper duct 10. To this end, the transfer hole 26 is disposed at the upper portion of the lower intake port 22 in the state where the exhaust system 1 is installed in the cooker 100. In addition, the lower intake port 22 and the transfer hole 26 are each formed on one surface of the lower suction part 21 and the transfer part 25 corresponding to a surface opposed to each other based on the lower duct 20. In the first exemplary embodiment, the lower intake port 22 is formed on one surface corresponding to the bottom surface of the lower suction part 21 and the transfer hole 26 is formed on one surface corresponding to the front surface of the transfer part 25, in the state where the exhaust system 1 is installed in the cooker 100.

The transfer hole 26 is disposed at the upper portion of the lower intake port 22 in the state where the exhaust system 1 is installed in the cooker 100. This is to transfer the exhaust gas of the lower cooking chamber 141 sucked through the lower intake port 22 and flowing into the lower passage 20P to the upper duct 10 through the transfer hole 26 by natural convection. In addition, to this end, the transfer hole 26 communicates with the communication hole 13 in the state where one surface of the upper duct 10 is closely attached to one surface of the lower duct 20, in more detail, one surface of the suction part 11 is closely attached to one surface of the transfer part 25.

Meanwhile, the upper duct 10 and the lower duct 20 are provided with a component for fixing to each other and fixing to the cooker 100. The upper duct 10 and the lower duct 20 are fixed to each other by a first fastener S1 and the upper duct 10 and the lower duct 20 fixed to each other are fixed to the cooker 100 by a second fastener S2.

In detail, the upper duct 10 is provided with a flange 14. Substantially, the flange 14 is provided at the lower end of the suction part 11. The flange 14 is provided with a first through hole 15. The lower duct 200 is provided with a first fastening hole 27. The first fastening hole 27 is formed on one surface of the transfer part 25, in more detail, one surface of the transfer part 25 formed on which the transfer hole 26 is formed. The first through hole 15 and the first fastening hole 27 communicate with each other, in the state where the upper duct 10 is closely attached to the lower duct 20 so that the communication hole 13 and the transfer hole 26 communicate with each other. The first fastener S1 is fastened to the first fastening hole 27 by penetrating through the first through hole 15, so that the upper duct 10 and the lower duct are fixed to each other.

The lower duct 20 is provided with a first through hole 23 and a third through hole 24. The second through hole 23 and the third through hole 24 are formed at a position corresponding to each other on both surfaces of the lower suction part 21. That is, the second through hole 23 is formed on one surface of the lower suction part 21 on which the lower intake port 22 is formed and the third through hole 24 is formed at a surface opposite to one surface of the lower suction part 21 on which the lower suction part 2 and the second through hole 23 are formed. The second fastener S2 is fastened at one side of the cooker 100 in the state where it sequentially penetrates through the second and third through holes 23 and 24, such that the upper duct 10 and the lower duct 20 are fixed to the cooker 100.

Figure 4:
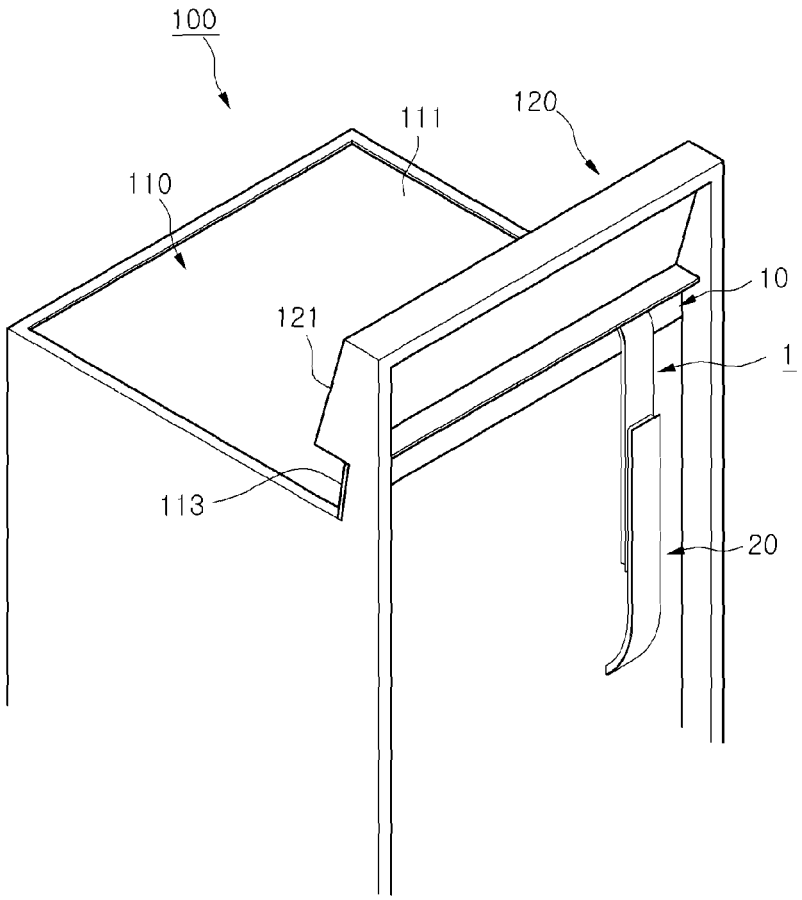
FIG. 4 is a perspective view of the exhaust system according to the first exemplary embodiment of the present invention.
Figure 5:
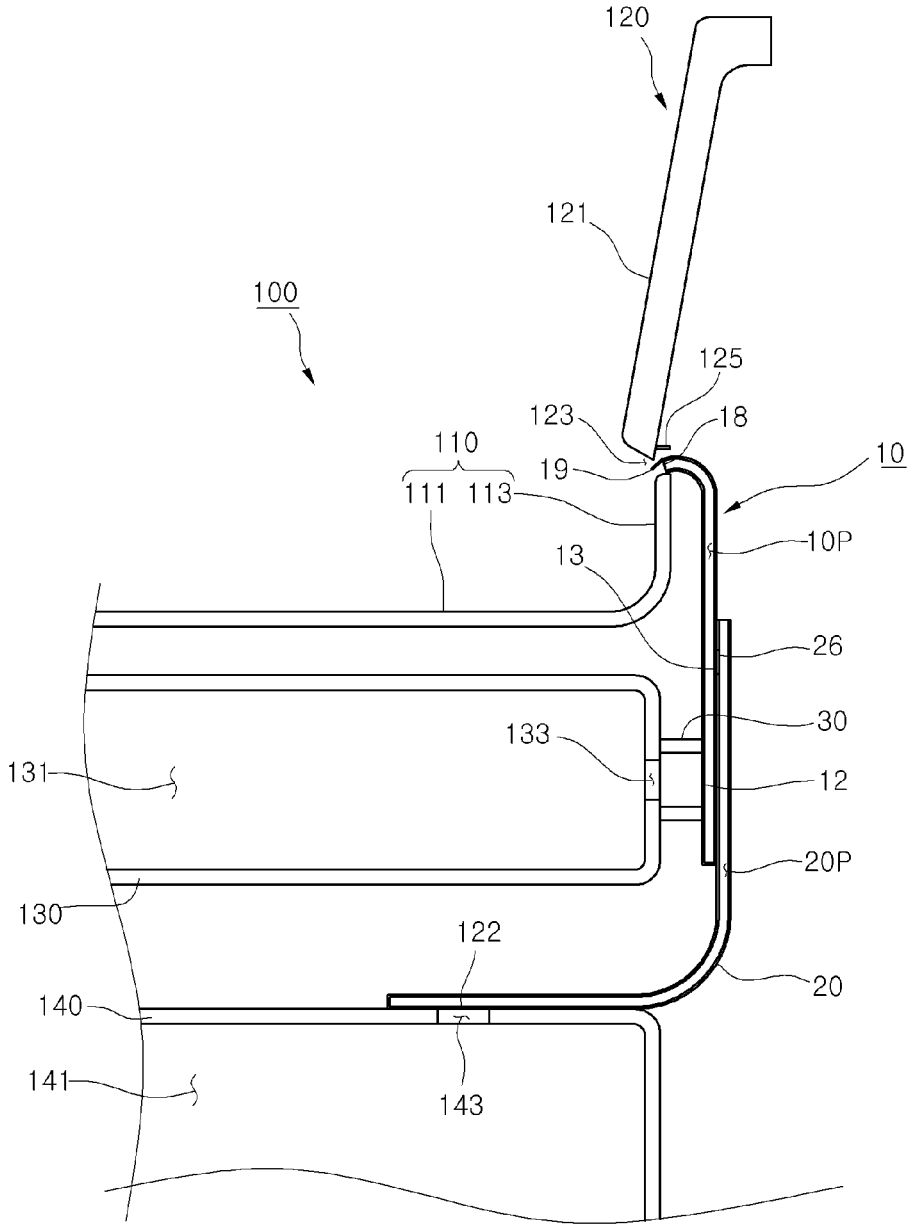
FIG. 5 is a longitudinal cross-sectional view of the exhaust system according to the first exemplary embodiment of the present invention.

FIG. 4 is a perspective view showing a state where the exhaust system according to the first exemplary embodiment of the present invention is installed in the cooker and FIG. 5 is a longitudinal cross-sectional view showing a state where the exhaust system according to the first exemplary embodiment of the present invention is installed in the cooker.

Referring to FIGS. 4 and 5, a top plate 110 is provided on the upper surface of the cooker 100. The top plate 100 includes an upper portion 111 and a rear portion 113. The upper portion 111 forms the upper surface appearance of the cooker 100. The rear portion 113 is vertically bent at the rear end of the upper portion 111 thereof. The top plate 110 is made of a metal material. Substantially, the top plate 110 may serve to transfer heat of a heating source (not shown) positioned at the lower portion thereof to a cooking pot seated on the upper surface thereof.

The upper rear end of the cooker 100 is provided with a controller 120. The controller 120 receives signals the operation of the cooker 100 or displays information on the operation of the cooker 100 to the outside. The controller 120 extends upwardly from the upper rear end of the cooker 100.

The front appearance of the controller 120 is formed on a control panel 121. The lower end of the control panel 121 is spaced by a predetermined interval from the upper end of the rear portion 113. For convenience of explanation, a space between the upper end of the rear portion and the lower end of the control panel 121 is referred to as an exhaust slot 123.

Meanwhile, the control panel 121 may be made of, for example, a synthetic resin material. The rear lower end of the control panel 121 adjacent to the rear portion 113 is provided with a suction preventing rib 125. The suction preventing rib 125 is extended to be substantially horizontal backwardly from the rear surface of the control panel 121. The suction preventing rib 125 prevents the exhaust gas discharged through the external exhaust port 18 from being sucked into the inside of the cooker 100 through the exhaust slot 120, substantially, into the control panel 121.

Meanwhile, an upper cavity 13-0 and a lower cavity 140 are provided in the cooker 100. The cavity 130 and the lower cavity 140 are stacked up and down. The inside of the upper cavity 130 is provided with an upper cooking chamber 131 and the inside of the lower cavity 140 is provided with a lower cooking chamber 141. The upper cooking chamber 131 and the lower cooking chamber 141 each cook foods.

To this end, the inside of the cooker 100 is provided with a plurality of heating sources to cook foods in the upper cooking chamber 131 and the lower cooking chamber 141. Although not shown, in the first exemplary embodiment, the upper side of the upper cooking chamber 131 may be provided with an upper broil heater. An example of the upper broil heater may include a carbon heater or/and a sheathe heater. The upper broil heater performs radiant heating on foods in the upper cooking chamber 131. In addition, the lower broil heater (not shown) may be provided on the upper portion of the lower cooking chamber 141, a lower bake heater (not shown) may be provided at the lower portion of the lower cooking chamber 141, and the rear surface of the lower cooking chamber 141 may be provided with a convection apparatus (not shown). As the lower broil heater and the lower broil heater, the carbon heater or/and the sheathe heater may each be used. The lower broil heater may perform the radiant heating on foods in the lower cooking chamber 141, the lower bake heater may heat air in the lower cooking chamber 141, and the convection apparatus may convect air in the lower cooking chamber. In this case, the heating source for cooking foods in the upper cooking chamber 131 and the heating source for cooking foods in the lower cooking chamber 141 may be operated independently from each other.

The rear surface of the upper cavity 130 and the upper surface of the lower cavity 140 are each provided with an upper exhaust port 113 and a lower exhaust port 143. The upper exhaust port 133 and the lower exhaust port 143 each communicate with the upper intake port 12 and the lower intake port 22 in the state where the exhaust system 1 is installed in the cooker 100.

In the first exemplary embodiment, the upper exhaust port 133 communicates with the upper intake port 12 through a connection member 30 rather than directly communicating with the intake port 12. In more detail, the connection member 30 is formed in a cylindrical shape having a predetermined diameter. The both ends of the connection member communicate with the exhaust port 133 and the intake port 12, respectively. Therefore, the exhaust gas of the cooking chamber 131 may be transferred to the upper duct 10 through the connection member 30.

In addition, the connection member 30 serves to substantially maintain the interval between the upper cavity 130 and the upper duct 10. In other words, the phenomenon that heat generated during cooking foods in the upper cavity 130 is transferred from the upper cavity 130 to the upper duct 10 can be prevented by substantially spacing between the upper cavity 130 and the upper duct 10 by the connection member 30.

Hereinafter, a process of discharging the exhaust gas of the cooker according to a first exemplary embodiment of the present invention will be described in more detail with reference to the accompanying drawings.

Figure 6:
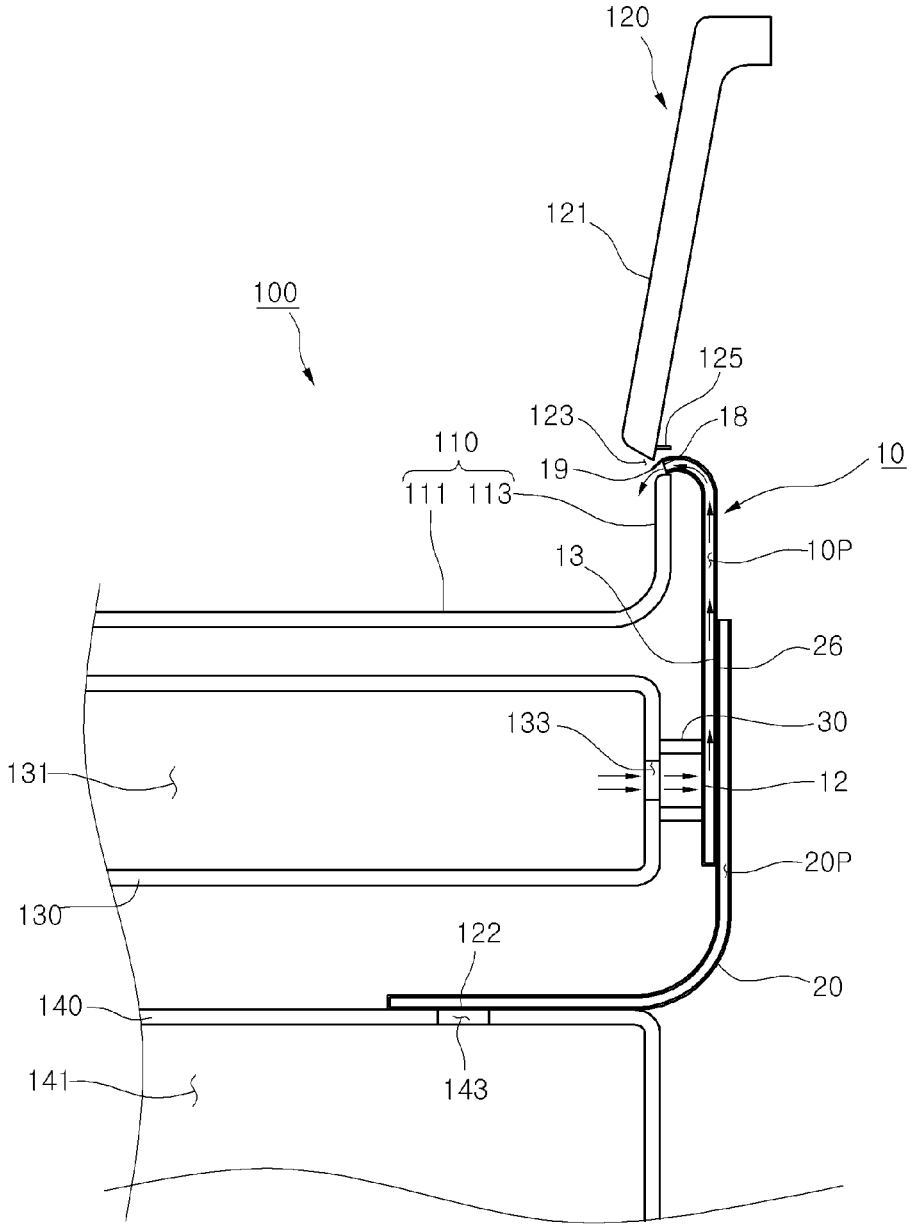
FIGS. 6 to 8 are operation state diagrams showing a process of discharging exhaust gas generated by the cooker according to the first exemplary embodiment of the present invention.
Figure 7:
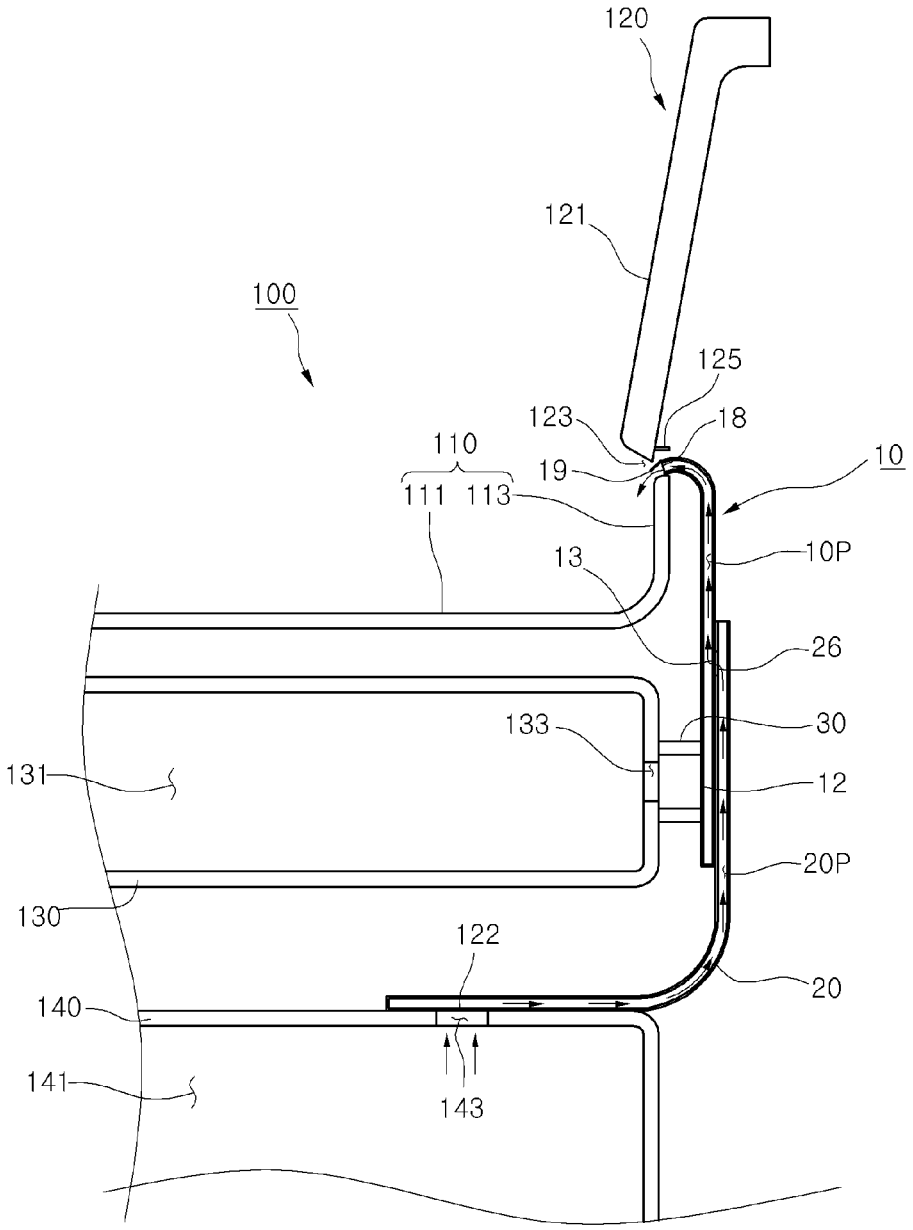
Figure 8:
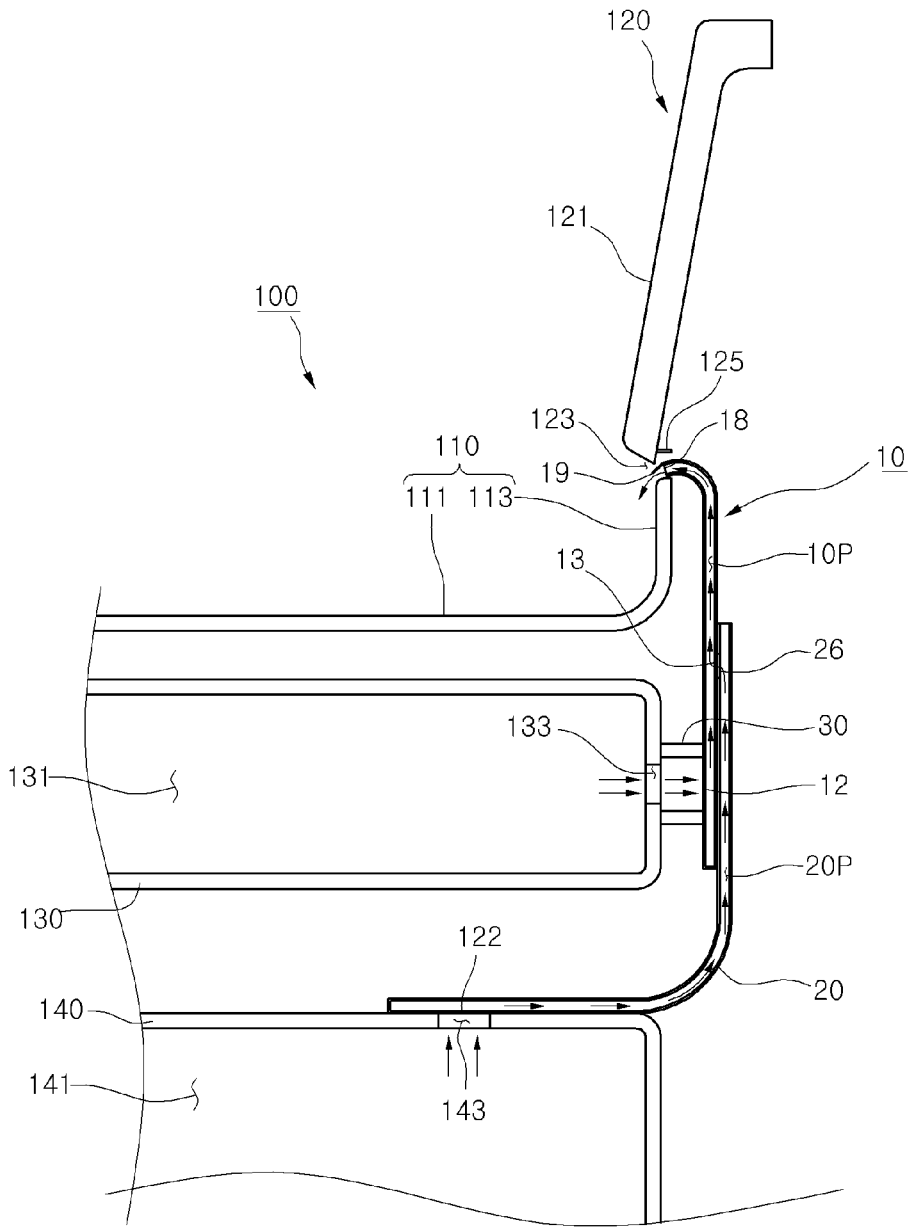

FIGS. 6 to 8 are operation state diagrams showing a process of discharging the exhaust gas according to the first exemplary embodiment of the present invention;

Referring first to FIG. 6, when foods are cooked only in the upper cooking chamber 131, the exhaust gas generated during a process of cooking foods in the upper cooking chamber 131 is discharged to the outside through the upper cooking chamber 131 by natural convection. In detail, the exhaust gas of the upper cooking chamber 131 is sucked into the inside of the upper duct 10 of the exhaust system 1, that is, the upper passage 10P through the exhaust port 133 and the upper intake port 12. In this case, the exhaust gas of the upper cooking chamber 131 will flow into the connection member 30 that communicates the upper exhaust port 133 with the upper intake port 12.

The exhaust gas sucked into the upper passage 10P flows into the upper passage 10P and is discharged to the outside through the external exhaust port 18. In this case, the exhaust gas discharged through the external exhaust port 18 is guided to be downwardly inclined by the guide rib 19. In addition, the phenomenon that the exhaust gas discharged through the external exhaust port is sucked into the control panel 121 through the exhaust slot 123 by the suction preventing rib 125 is prevented.

Meanwhile, the upper passage 10P substantially communicates with the inside of the lower duct 20, that is, the lower duct 20P by the communication hole 13 and the transfer hole 26. However, the lower intake port 22 communicating with the lower cooking chamber 141 is disposed at the side lower than the transfer hole 26. Therefore, the phenomenon that the exhaust gas flowing into the upper passage 10P is transferred to the lower passage 20P through the transfer hole 26 or the exhaust gas flowing into the lower passage 20P is transferred to the lower cooking chamber 141 through the lower intake port 22.

Next, referring to FIG. 7, when foods are cooked only in the lower cooking chamber 141, the exhaust gas generated during a process of cooking foods in the lower cooking chamber 141 is discharged to the outside through the exhaust system 1 by natural convection. In more detail, the exhaust gas of the lower cooking chamber 141 is transferred to the lower passage 20P of the upper duct 20 of the exhaust system 1 through the lower exhaust port 143 and the lower intake port 22.

The exhaust gas sucked into the lower passage 20P flows into the lower passage 20P and the is transferred to the upper passage 10P through the transfer hole 26 and the communication hole 13. The exhaust gas transferred to the upper passage 10P is discharged to the outside through the external exhaust port 18. The guide of the exhaust gas by the guide rib 19 and the suction prevention of the exhaust gas by the suction preventing rib 125 are already described above.

However, the communication hole 13 and the transfer hole 26 are disposed at the upper side of the upper intake port 12. Therefore, the phenomenon that the exhaust gas transferred from the lower passage 20P to the upper passage 10P reflows into the upper cooking chamber 131 through the upper intake port 12 is prevented.

Finally, referring to FIG. 8, when foods are cooked both in the upper cooking chamber 131 and the lower cooking chamber 141, the exhaust gas of the upper cooking chamber 131 and the lower cooking chamber 141 is discharged to the outside through the exhaust system 1. In more detail, the exhaust gas of the upper cooking chamber 131 is transferred to the upper passage 10P through the upper exhaust port 133 and the upper intake port 12 and flows into the upper passage 10P to be discharged to the outside through the external exhaust port 18. The exhaust gas of the lower cooking chamber 141 is transferred to the lower passage 20P through the lower exhaust port 143 and the lower intake port 22 and is again transferred to the upper passage 10P through the transfer hole 26 and the communication hole 13. The exhaust gas of the lower cooking chamber 141 transferred to the upper passage 10P is discharged to the outside through the external exhaust port 18, together with the exhaust gas of the upper cooking chamber 131. The guide of the exhaust gas by the guide rib 19 and the suction prevention of the exhaust gas by the suction preventing rib 125 are already described above.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Although not shown, the upper intake port 12 or/and the lower intake port 22 or/and the upper exhaust port 133 or/and the lower exhaust port 143 are provided with filters. The filter serves to remove foreign materials of the exhaust gas of the upper cooking chamber 131 sucked into the exhaust system 1 through the upper exhaust port 133 and the upper intake port 12 or/and the exhaust gas of the lower cooking chamber 141 sucked into the exhaust system 1 through the lower exhaust port 143 and the lower intake port 22.

Further, the foregoing exemplary embodiment describes that the exhaust gas of the upper cooking chamber 131 and the lower cooking chamber 141 are discharged to the outside by the exhaust system 1 but is not necessarily limited thereto. In other words, the exhaust system 1 may discharge the exhaust gas of a plurality of cooking chambers vertically stacked, for example, at least three cooking chambers to the outside.

Hereinafter, a cooker according to a second exemplary embodiment of the present invention will be described in more detail with reference to the accompanying drawings. The same components as those of the first exemplary embodiment among components of the second exemplary embodiment recite reference numerals of FIGS. 1 to 8 and the detailed description thereof will be omitted.

Figure 9:
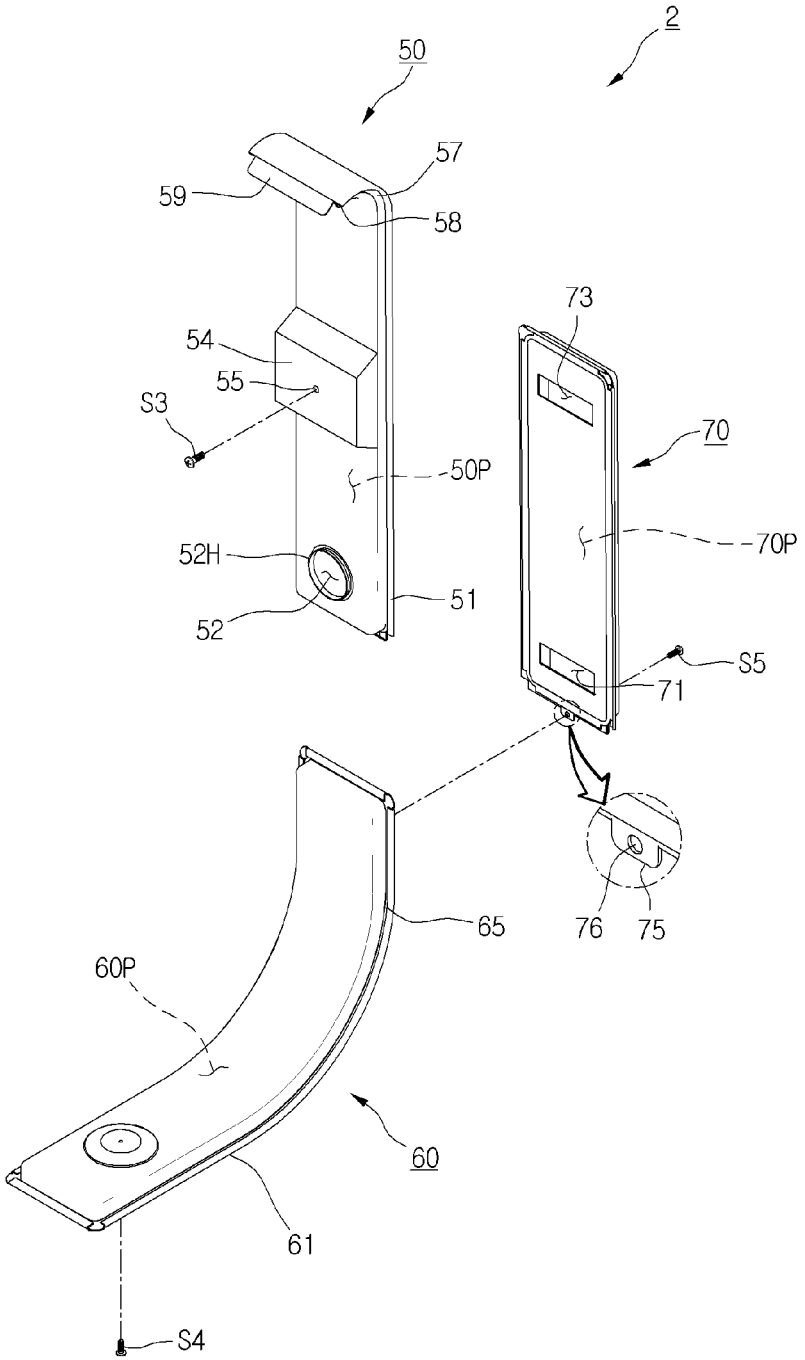
FIG. 9 is an exploded perspective view showing an exhaust system of a cooker according to a second exemplary embodiment of the present invention.
Figure 10:
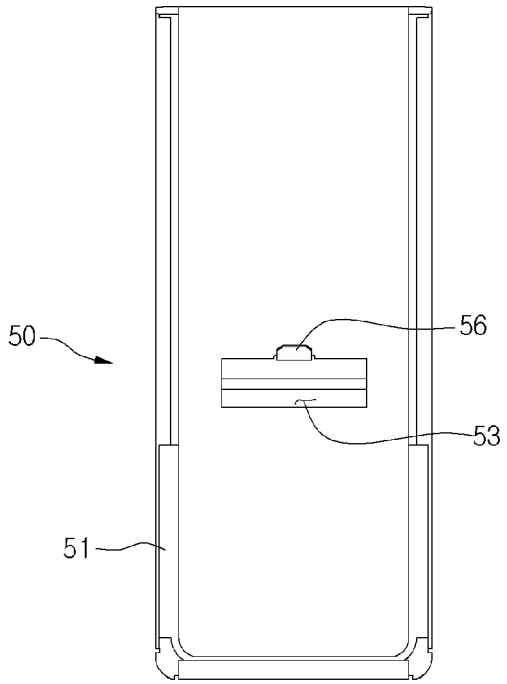
FIG. 10 is a rear view of a rear surface of an upper duct configuring a second exemplary embodiment of the present invention.
Figure 11:
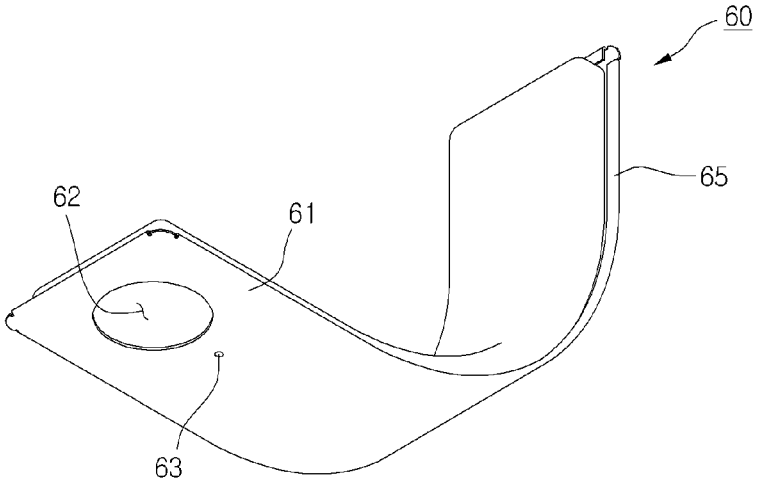
FIG. 11 is a perspective view showing a lower duct configuring the second exemplary embodiment of the present invention.
Figure 12:
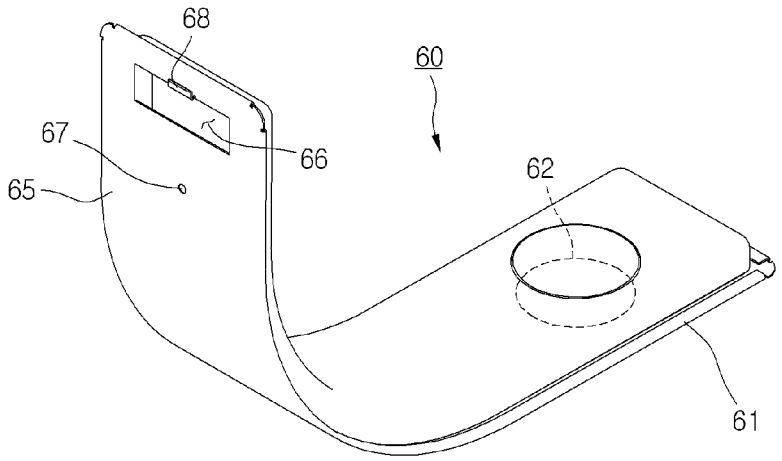
FIG. 12 is a perspective view showing the lower duct configuring the second exemplary embodiment of the present invention viewed from another angle.

FIG. 9 is an exploded perspective view showing an exhaust system of a cooker according to a second exemplary embodiment of the present invention, FIG. 10 is a rear view of a rear surface of an upper duct configuring a second exemplary embodiment of the present invention, FIG. 11 is a perspective view showing a lower duct configuring the second exemplary embodiment of the present invention, and FIG. 12 is a perspective view showing the lower duct configuring the second exemplary embodiment of the present invention viewed from another angle.

Figure 13:
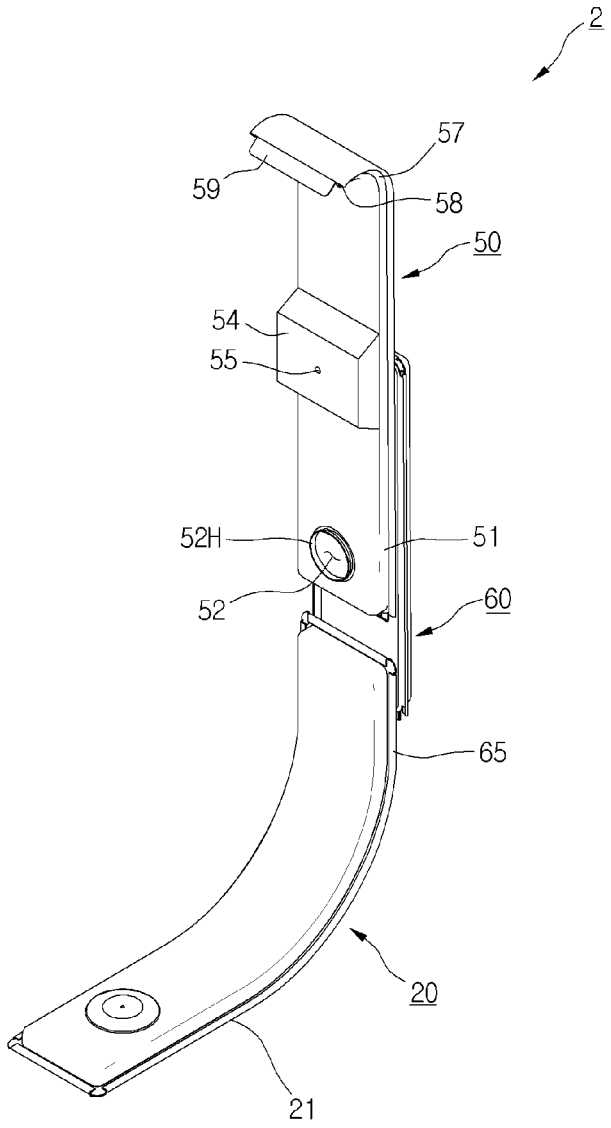
FIG. 13 is a perspective view showing a combined state of the exhaust system according to the second exemplary embodiment of the present invention.

Referring to FIGS. 9 to 11, the exhaust system 2 includes an upper duct 50, a lower duct 60, and a connection duct 70. The upper duct 50 serves to discharge exhaust gas generated during cooking foods in the upper cooking chamber 131 (see FIG. 13) to the outside. The lower duct 60 serves to discharge exhaust gas generated during cooking foods in a lower cooking chamber 141 (see FIG. 13) to the outside. The connection duct 70 serves to transfer the exhaust gas of the lower cooking chamber 141 flowing into the lower duct 60 to the upper duct 50.

The upper duct 50 includes an upper suction part 51 and a discharge part 57. The upper sucking unit 51 is lengthily formed in a length direction (approximately a vertical direction in the state where the exhaust system 2 is installed in a cooker 100 (see FIG. 13)). The discharge part 57 is bent at one end of the upper suction part 51 at a predetermined curvature. Substantially, the upper suction part 51 and the discharging part 57 may be integrally formed by bending a portion of an upper end portion of a tube having a predetermined length to entirely have a hook shape. The upper passage 50P is provided in the upper duct 50.

The upper suction part 51 is provided with an upper intake port 52 and an suction hole 53. The end of the discharging part 57 is provided with an external exhaust port 58. In this configuration, the upper intake port and the suction hole 53 are formed at a surface opposed to each other of the upper suction part 51. In the first exemplary embodiment, the upper intake port 52 is formed on one surface corresponding to the front surface of the upper suction part 51 and the suction hole 53 is formed on one surface corresponding to the rear surface of the upper suction part 51, in the state where the exhaust system 2 is installed in the cooker 100. The exhaust gas generated from the upper cooking chamber 131 is sucked into the upper passage 50P through the upper intake port 52. The exhaust gas generated from the lower cooking chamber 141 and flowing into the lower duct 60 is transferred into the upper passage 50P through the suction hole 53. The exhaust gas generated from the upper cooking chamber 131 or/and the lower cooking chamber 141 flowing into the upper passage 50P is discharged to the outside through the external exhaust port 58.

In addition, a fastening rib 52H is provided on the front surface of the upper duct 50 adjacent to an outer peripheral portion of the intake port 52. The fastening rib 52H serves to connect a connection member 80 to be described later. The fastening rib 52H is protruded forwardly from the front surface of the upper duct 50.

Meanwhile, the external exhaust port 58 is disposed on the upper sides the upper intake port 52 and the suction hole 53 in the state where the exhaust system 2 is installed in the cooker 100. This is to discharge the exhaust gas from the upper cooking chamber 131 and the lower cooking chamber 141, which is sucked and transferred through the upper intake port 52 and the suction hole 53 and flowing into the upper passage 50P, to be discharged through the external exhaust port 58 by natural convection.

In addition, the suction hole 53 is disposed at a relatively higher position than the upper intake port 12 in the state where the exhaust system 2 is installed in the cooker 100. This is to prevent the exhaust gas from the lower cooking chamber 141 transferred into the upper passage 50P through the suction hole 53 from reflowing into the upper cooking chamber 131 through the upper intake port 52.

In addition, a flowing interference preventing part is provided in the upper duct 50. The flowing interference preventing part 54 is formed by relatively further protruding one surface of the upper duct 50 corresponding to an opposite side of the suction hole 52, that is, a portion of the front surface of the upper suction part 51 forwardly than the remaining portion of the upper suction part 51, in the state where the exhaust system 2 is installed in the cooker 100 The flowing sectional area of a portion of the upper passage 50P is substantially increased by the flowing interference part 54. This is to prevent the flowing exhaust gas of the upper cooking chamber 131 sucked through the intake port 52 and flowing into the upper passage 50P from being interfered due to the exhaust gas of the lower cooking chamber 141 transferred through the suction hole 52. As such, the flowing interference preventing part 54 is formed by protruding a portion of the front surface of the upper suction part 51, such that it is closely attached to the cooker 100 in the state where the exhaust system 100 is installed in the cooker 100.

The second exemplary embodiment forms the flowing interference prevention part 54 by protruding a portion of the front surface of the upper suction part 51 corresponding to an opposite side of the suction hole 52 forwardly, but is not necessarily limited thereto. For example, a portion of the left and right surfaces of the upper suction part 51 corresponding to the suction hole 52 is relatively further extended left and right than the remaining portion of the upper suction part 51, such that the flowing interference preventing part 54 may be formed. In addition, a portion of the rear surface of the suction part 51 including the suction hole 52 is relatively further protruded backwardly than the remaining rear surface of the upper suction part 51, such that the flowing interference preventing part 54 may also be formed.

The upper duct 100 is provided with the guide rib 19. The guide rib 19 serves to guide the exhaust gas of the upper cooking chamber 131 and/or the lower chamber 141 discharged through the external exhaust port 58. In the second exemplary embodiment, the guide rib 19 is extended to be inclined at a predetermined angle at one side of the discharge part 57 corresponding to the upper end of the external exhaust port 58. In this configuration, the guide rib 19 is extended to be downwardly inclined toward the front of the cooker 100 in order to guide the exhaust gas discharged through the external exhaust port 58 to be downwardly inclined in the state where the exhaust system 2 is installed in the cooker 100.

The lower duct 60 includes a lower suction part 61 and a transfer part 65. The lower suction part 61 is lengthily formed in a length direction (a horizontal direction in the state where the exhaust system 2 is installed in the cooker 100). The transfer part 65 is extended to be inclined at one end of the lower suction part 61 at a predetermined angle. The lower suction part 61 and the transfer part 65 may substantially be formed by bending one tube into approximately an L-letter shape. A lower passage 60P is provided in the inside of the lower duct 60, that is, the insides of the lower suction part 61 and the transfer part 65.

Meanwhile, the lower duct 60 is provided with a lower intake port 62 and a discharge hole 66. The lower inlet part 62 serves to suck the exhaust gas generated from the lower cooking chamber 141 into the inside of the lower duct 60, that is, the lower passage 60P. The exhaust port serves as an outlet that transfers the exhaust gas sucked through the lower intake port 62 and flows into the lower passage 60P to the connection duct 60. To this end, the discharge hole 66 is disposed at the upper portion of the lower intake port 62 in the state where the exhaust system 2 is installed in the cooker 100. In addition, the lower intake port 62 and the discharge hole 66 are each formed on one surface of the lower suction part 61 and the transfer part 65 corresponding to the same surface as each other based on the lower duct 60. In the second exemplary embodiment, the lower intake port 62 is formed on one surface corresponding to the bottom surface of the lower suction part 61 and the discharge hole 66 is formed on one surface corresponding to the rear surface of the transfer part 65, in the state where the exhaust system 2 is installed in the cooker 100.

The discharge hole 66 is disposed at the upper portion of the lower intake port 22 in the state where the exhaust system 2 is installed in the cooker 100. This is to transfer the exhaust gas of the lower cooking chamber 141 sucked through the lower intake port 62 and flowing into the lower passage 60P to the upper duct 50 through the discharge hole 66 by natural convection.

Meanwhile, the connection passage 70P is provided in the connection duct 70. The exhaust gas of the lower cooking chamber 141 transferred from the lower duct 60 flows in the connection passage 70P. The exhaust gas of the lower cooking chamber 141 flowing into the lower passage 60P is transferred to the upper duct 50.

The connection duct 70 is provided with first and second communication holes 71 and 73. The first and second communication holes 71 and 73 are formed on the front surface of the connection duct 70 in the state where the exhaust system 2 is installed in the cooker 100. In this configuration, the communication hole 71 is disposed at a position lower than the second communication hole 73. The first communication hole 71 communicates with the discharge hole 66 and the second communication hole 73 communicates with the suction hole 52. Therefore, the connection passage 70P communicates with the upper passage 50P and the lower passage 60, respectively, by the first and second communication holes 71 and 73.

In the secondary exemplary embodiment, the first and second communication holes 71 and 73 are each formed to be relatively larger than the discharge hole 66 and the suction hole 52. In more detail, the first and second communication holes 71 and 73 are each formed to be relatively higher than the discharge hole 66 and the suction hole 52. This is to fasten the first and second fastening hooks 16 and 68.

The upper duct 50 and the lower duct 60 are fixed to the cooker by first and second fasteners S3 and S4. The connection duct 70 is fixed to the lower duct 60 by a third fastener S5 in the state where it is fixed to the upper duct 50 by hook fastening. To this end, the upper duct 50, the lower duct 60, and the connection duct 70 are provided with a components for fixing to each other and fixing to the cooker 100.

In more detail, the upper duct 50 is provided with the first fastening hole 15. In the second exemplary embodiment, the first fastening hole 15 is formed at one side of the front surface of the suction part 51 corresponding to the flowing interference preventing part 54. The first fastening hole 15 is fastened with the first fastener S3 penetrating through one side of the cooker 100, substantially an insulation member (not shown). The insulation member is provided in the cooker 100 so that it is disposed at the rear sides of the upper cavity 130 and the lower cavity 140. Of course, the first fastener S3 may be fastened to the first fastening hole 15 penetrating through the cavity 130.

In addition, a first fastening hook 16 is provided in the upper duct 50. The first fastening hook 16 is formed at one side of the rear surface of the discharge part 57 corresponding to the upper side of the suction hole 52. The first fastening hook 16 is to hook-fasten with the connection duct 70.

The lower duct 60 is provided with the second and third fastening holes 63 and 67. The second fastening hole is fastened with the second fastener S4 penetrating through one side of the cooker 100. The third fastening hole 67 is fastened with the third fastener S5 penetrating through a through hole 76 to be described later. The second fastening hole 63 is formed at the bottom surface of the lower suction part 61 and the third fastening hole 67 is formed at the rear surface of the transfer part 65 corresponding to the lower side of the discharge hole 66.

The lower duct 60 is provided with the second fastening hook 68. The second fastening hook 68 is formed at one side of the rear surface of the transfer part 65 corresponding to the upper side of the discharge hole 66. The second fastening hook 68 is to hook-fasten with the connection duct 70. The second fastening hook 68 is formed at one side of the rear surface of the transfer part 65 corresponding to the upper side of the discharge hole 66.

The connection duct 70 is provided with the flange 75. The flange 75 is extended downwardly from the lower end of the connection duct 70. The flange 75 is provided with the through hole 76. The through hole 76 is a part through which the third fastener S5 fastened with the third fastening hole 67 penetrates. In addition, as described above, the first and second communication holes 71 and 73 are each formed to be relatively higher than the discharge hole 66 and the suction hole 52. Therefore, the first and second communication holes 71 and 73 may be fastened with the first and second fastening hooks 16 and 68, respectively.

Therefore, in the second exemplary embodiment, the upper duct 50 is fixed to the rear surface (substantially the rear surface of the upper cavity 130 to be described later) of the upper cooking chamber 131 by the first fastener S3 and the lower duct 60 is fixed to the upper surface (substantially the upper surface of the lower cavity 130 to be described later) of the lower cooking chamber 141 by the second fastener S4. The connection duct 70 is fixed to the upper duct 50 and the lower duct 60 by the hook connection in the state where the upper duct 50 and the lower duct 60 is fixed by the first and second fasteners S3 and S4. In this case, the first and second fastening hooks 16 and 68 are each fastened with the first and second communication holes 71 and 73. Next, the third fastener S5 is fastened with the third fastening hole 67 by penetrating through the through hole 76, such that the fixing among the upper duct 50, the lower duct 60, and the connection duct 70 configuring the exhaust system 2 and the installation into the cooker 100 of the exhaust system 1 are made.

Hereinafter, the second exemplary embodiment of the cooker according to the present invention will be described in more detail.

Figure 14:
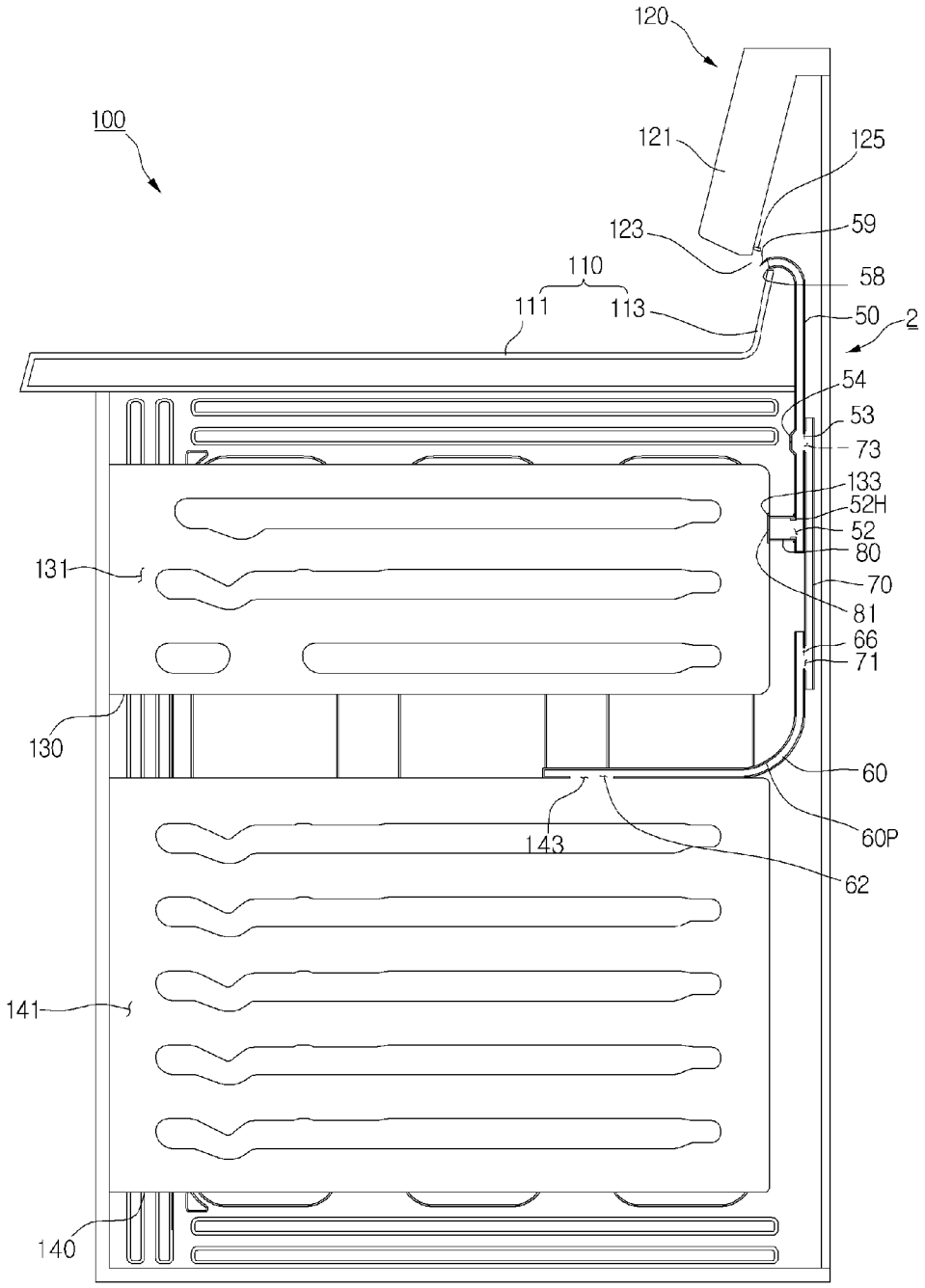
FIG. 14 is a longitudinal cross-sectional view of the cooker according to the second exemplary embodiment of the present invention.

FIG. 14 is a longitudinal cross-sectional view of the cooker according to the second exemplary embodiment of the present invention.

Referring to FIG. 14, in the exemplary embodiment, the upper duct 50 and the lower duct 60 are fixed to the upper cavity 130 or the lower cavity 140 by fastening the first or second fastening hole S4 penetrating through the upper cavity 130 or the lower cavity 140 to the first or the second fastening hole 63.

The connection member 80 is provided between the rear surfaces of the upper duct 50 and the cavity 130. The connection member 80 connects the upper duct 50 to the upper cavity 130, that is, the upper intake port 52 to the upper exhaust port 133. In the second exemplary embodiment, the connection member 80 is formed in a substantially cylindrical shape but the shape of the connection member 80 is not limited thereto. Substantially, the connection member 80 transfers the exhaust gas of the upper cooking chamber 131 discharged through the upper exhaust port 133 to the upper duct 50, that is, the upper passage 50P through the upper intake port 52.

In more detail, the connection member 80 is installed by penetrating through the upper exhaust port 133 in the upper cavity 130. The fastening rib 52H is inserted into the rear end of the connection member 80. In this case, the length of the connection member 80 is determined so that the rear end of the connection member 80 is spaced by a predetermined interval from the front surface of the upper duct 50 in the state where the fastening rib 52H is inserted into the rear end of the connection member 80 penetrating through the upper exhaust port 133. This is to prevent the phenomenon that the upper duct 50 fixed to the rear surface of the upper cavity 130 is interfered by the connection member 80 due to the operation errors, etc. In more detail, the length of the connection member 80 extending to the rear side of the upper cavity 130 may be longer than the length between the rear surface of the upper cavity 130 and the front surface of the upper duct 50 in the state where the connection member 80 penetrates through the exhaust port 133. The reason is that although the length of the connection member 80 extending to the rear side of the upper cavity 130 is designed to be the same as the length between the rear surface of the upper cavity 130 and the front surface of the upper duct 50 at the initial design, the dimension therebetween may be different from each other. In this case, the upper duct 50 is not fixed to the upper cavity 130 by the connection member 80 or the upper duct 50 is pushed and bent by the connection member 80, such that the combustion gas of the cooking chamber 131 may be not transferred to the upper duct 10 and may be leaked to the outside during the transferring process. However, in the second exemplary embodiment, the occurrence of the above-mentioned problem is prevented by forming a predetermined interval between the rear end of the connection member 80 and the front surface of the upper duct 50.

In addition, the front end of the connection member 80 is provided with the filter 81. The filter 81 serves to filter foreign materials included in the combustion gas of the upper cooking chamber 81.

Hereinafter, a process of discharging the exhaust gas of the exhaust duct according to the second exemplary embodiment of the present invention will be described in more detail with reference to the accompanying drawings.

Figure 15:
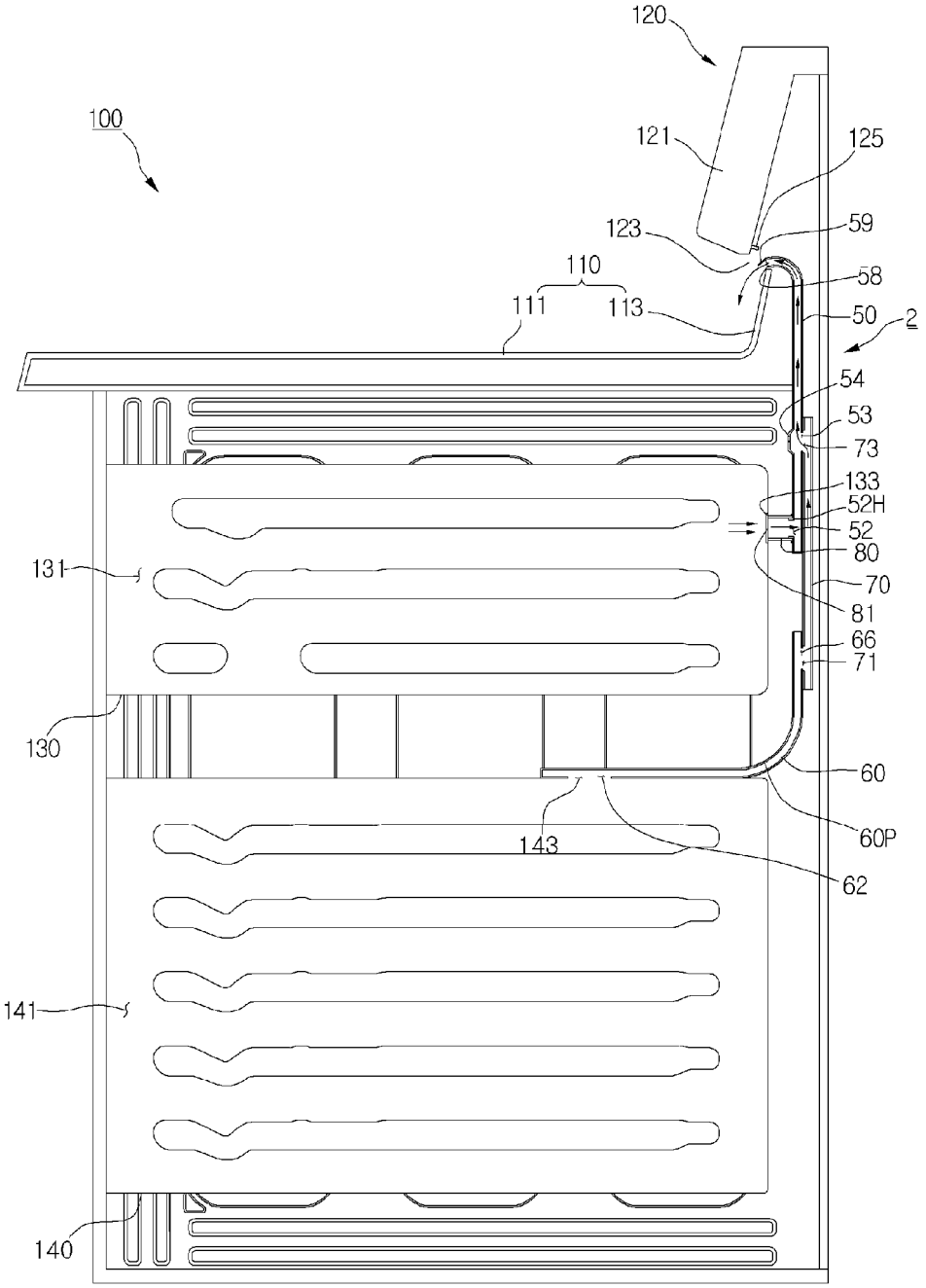
FIGS. 15 to 17 are operation state diagrams showing a process of discharging exhaust gas generated by the cooker according to the second exemplary embodiment of the present invention.
Figure 16:
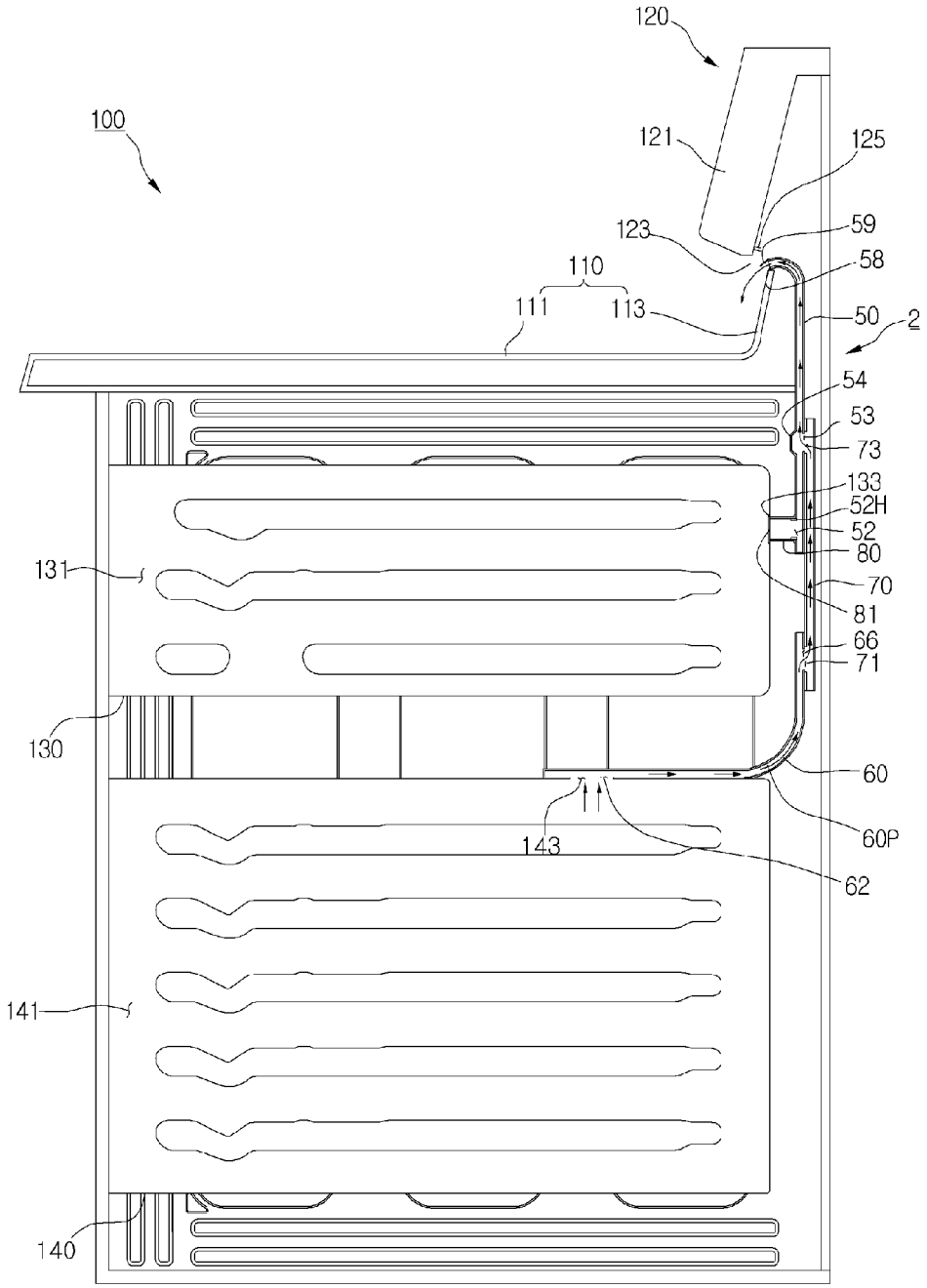
Figure 17:
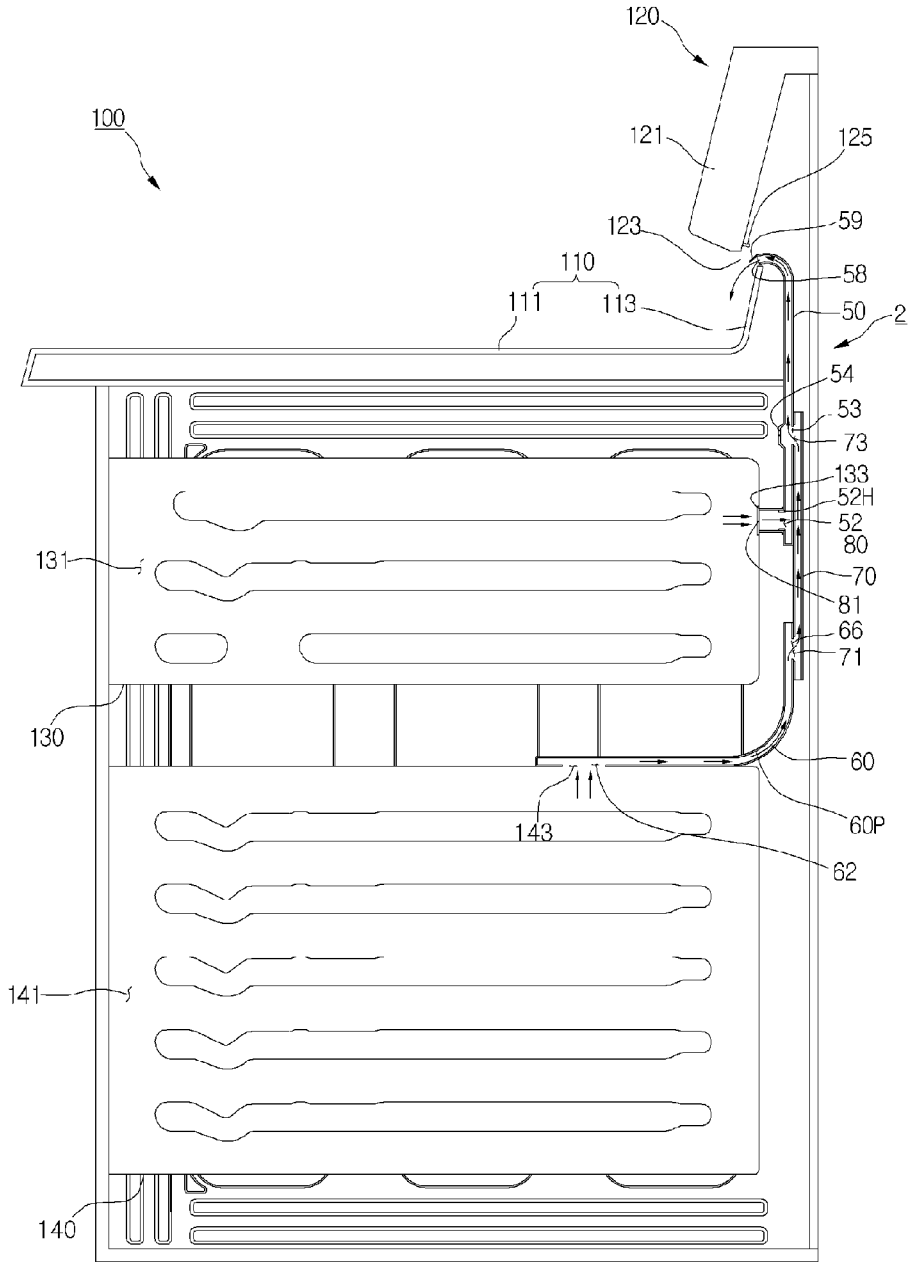

FIGS. 15 to 17 are operation state diagrams showing a process of discharging exhaust gas generated by the cooker according to the second exemplary embodiment of the present invention;

Referring first to FIG. 15, when foods are cooked only in the upper cooker 141, the exhaust gas generated during a process of cooking foods in the upper cooking chamber 131 is discharged to the outside through the exhaust system 2 by natural convection. In more detail, foods are cooked in the upper cooking chamber 141 by the broil heater or/and the upper bake heater. Therefore, the exhaust gas is generated in the upper cooking chamber 141 by cooking foods. In detail, the exhaust gas generated during cooking foods in the upper cooking chamber 131 is sucked into the inside of the upper duct 50 of the exhaust system 1, that is, the upper passage 10P through the exhaust port 133 and the upper intake port 52.

The exhaust gas sucked into the upper passage 50P flows into the upper passage 50P and is discharged to the outside through the external exhaust port 58. In this case, the exhaust gas discharged through the external exhaust port 58 is guided to be downwardly inclined by the guide rib 19. In addition, the phenomenon that the exhaust gas discharged through the external exhaust port 58 is sucked into the control panel 121 through the exhaust slot 123 by the suction preventing rib 125 is prevented.

Meanwhile, the upper passage 50P substantially communicates with the inside of the connection duct 60, that is, the connection passage 70P by the suction hole 52 and the second communication hole 73. The connection passage 70P communicates with the inside of the lower duct 60, that is, the lower passage 60P by the first communication hole 71 and the discharge hole 66. That is, the upper passage 50P substantially communicates with the lower passage 60P by the connection passage 70P.

However, the lower intake port 62 with which the lower passage 60P and the lower cooking chamber 141 are communicated is disposed at a position lower than the discharge hole 66 and the first communication hole 71 with which the lower passage 60P and the connection passage 70P and the suction hole 52 and the second communication hole with which the upper passage 52 and the connection passage 70P are communicated. Therefore, the exhaust gas of the upper cooking chamber 131 flowing into the upper passage 50P is transferred to the connection passage 70P through the suction hole 52 and the second communication hole 73 or is transferred to the lower passage 60P from the connection passage 70P, thereby preventing the exhaust gas from reflowing into the lower cooking chamber 141 through the lower intake port 62.

Next, referring to FIG. 16, when foods are cooked only in the lower cooking chamber 141, the exhaust gas generated during a process of cooking foods in the lower cooking chamber 141 is discharged to the outside through the exhaust system 2 by natural convection. In more detail, the foods in the lower cooking chamber 141 is heated by the lower broil heater or/and the lower bake heater or/and the convection apparatus. The exhaust gas generated during cooking foods in the lower cooking chamber 131 is transferred to the lower passage 60P of the lower duct 60 of the exhaust system 1 through the lower exhaust port 143 and the lower intake port 62.

The exhaust gas of the lower cooking chamber 141 sucked into the lower passage 60P flows into the lower passage 60P and is transferred to the connection passage 70P through the discharge hole 66 and the first communication hole 71. The exhaust gas of the lower cooking chamber 141 transferred to the connection passage 70P is transferred to the upper passage 50P through the second communication hole 73 and the suction hole 52. The exhaust gas transferred to the upper passage 50P is discharged to the outside through the external exhaust port 58. The guide of the exhaust gas by the guide rib 19 and the suction prevention of the exhaust gas by the suction preventing rib 125 are described above.

However, the suction hole 53 and the second communication hole 73 are disposed at the upper side of the upper intake port 52. Therefore, the phenomenon that the exhaust gas of the lower cooking chamber 141 transferred from the connection passage 70P to the upper passage 50P reflows into the upper cooking chamber 141 through the upper intake port 52 is prevented.

Finally, referring to FIG. 17, when foods are cooked both in the upper cooking chamber 131 and the lower cooking chamber 141, the exhaust gas of the upper cooking chamber 131 and the lower cooking chamber 141 is discharged to the outside through the exhaust system 2. In more detail, the exhaust gas of the upper cooking chamber 141 is transferred to the upper passage 50P through the upper exhaust port 133 and the upper intake port 52 and flows into the upper passage 50P to be discharged to the outside through the external exhaust port 58. The exhaust gas of the lower cooking chamber 141 is transferred to the lower passage 60P through the lower exhaust port 143 and the lower intake port 62 and is again transferred to the connection passage 70P through the discharge hole 66 and the first communication hole 71. Next, the exhaust gas of the lower cooking chamber 141 flowing into the connection passage 70P is transferred to the upper passage 50P through the second communication hole 73 and the suction hole 52. The exhaust gas of the lower cooking chamber 141 transferred to the upper passage 50P is discharged to the outside through the external exhaust port 58, together with the exhaust gas of the upper cooking chamber 141. The guide of the exhaust gas by the guide rib 19 and the suction prevention of the exhaust gas by the suction preventing rib 125 are described above.

Hereinafter, a cooker according to a third exemplary embodiment of the present invention will be described in more detail with reference to the accompanying drawings.

Figure 18:
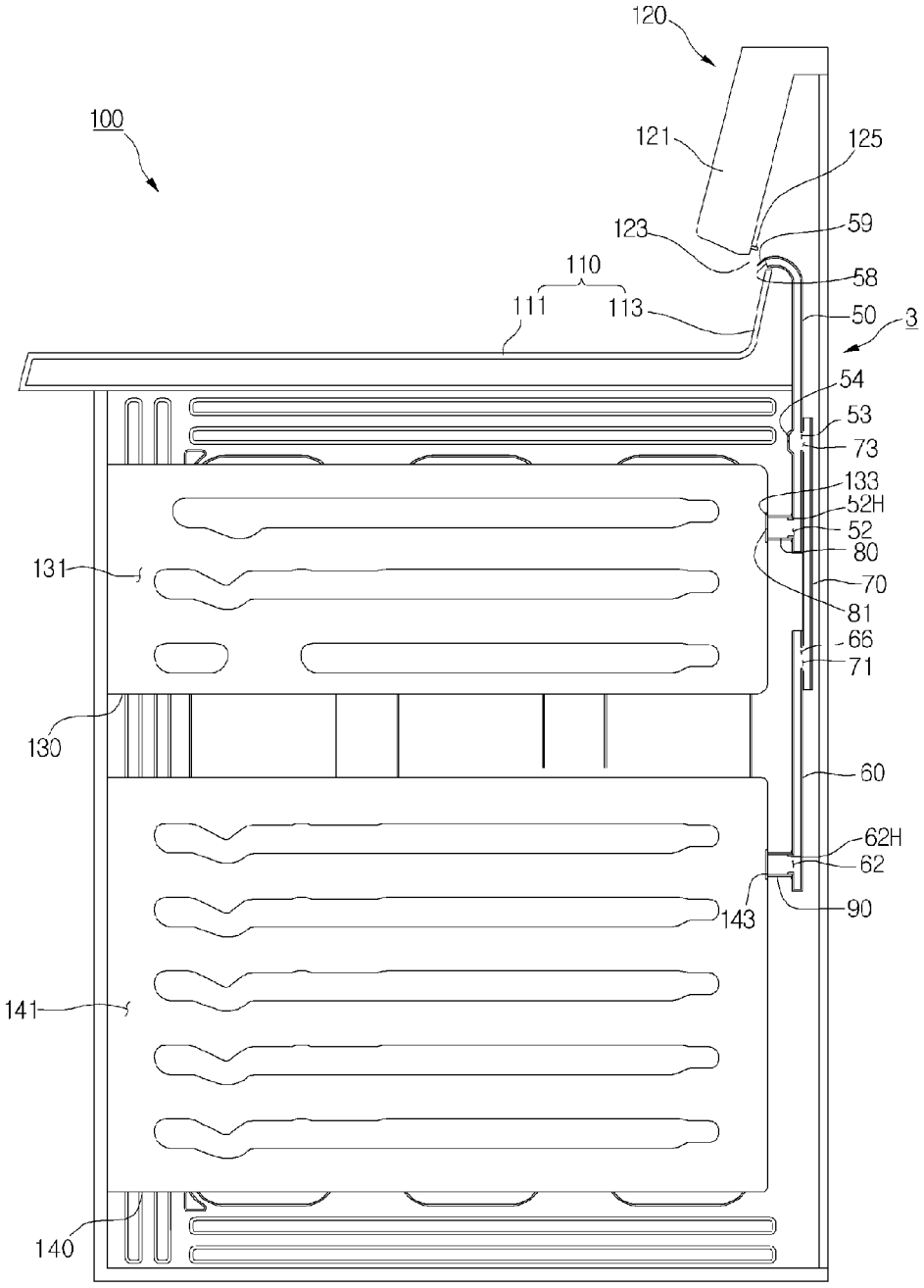
FIG. 18 is a longitudinal cross-sectional view of a cooker according to a third exemplary embodiment of the present invention.

FIG. 18 is a longitudinal cross-sectional view showing a cooker in which an exhaust duct is installed according to a third exemplary embodiment of the present invention. The same components as those of the second exemplary embodiment among components of the third exemplary embodiment recite reference numerals of FIGS. 9 to 17 and the detailed description thereof will be omitted.

Referring to FIG. 18, in the third exemplary embodiment, the lower duct 60 configuring the exhaust system 3 is lengthily formed vertically similar to the upper duct 50. Therefore, the lower duct 60 receives the exhaust gas generated during cooking foods in the lower cooking chamber 141 through the rear surface of the lower cooking chamber 141.

The remaining components of the lower duct 60, the components of the upper duct 50 and the connection duct 70 are the same as the second exemplary embodiment of the present invention described above. However, in the exemplary embodiment, the second fastener S4 (see FIGS. 9 to 11) for fixing the lower duct 60 will be fastened with the second fastening hole 63, penetrating through the rear surface of the lower cavity 140. The connection member 90 is further provided between the lower duct 60 and the lower cavity 140. The shape and function of the connection member may be the same as the connection member connecting between the upper duct 50 and the upper cavity 130.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Although not shown, even in the first exemplary embodiment of the present invention, the filter may be installed in the upper intake port or/and the lower intake port or/and the upper exhaust port or/and the lower exhaust port.

In addition, the foregoing exemplary embodiments describe the exhaust gas of the upper cooking chamber and the lower cooking chamber is discharged to the outside by the exhaust system but are not necessarily discharged. In other words, the exhaust system may discharge the exhaust gas of a plurality of cooking chambers vertically stacked, for example, at least three cooking chambers to the outside. In this case, the upper and lower cavities and the upper and lower cooking chambers may be referred to as the first and second cavities and the first and second cooking chambers, respectively.

What is claimed is:

1. A cooker, comprising:

a main body including a first cavity having a first cooking chamber and an upper exhaust port and a second cavity disposed at a lower side of the first cavity and having a second cooking chamber;

a first heating source providing heat for cooking foods in the first cooking chamber;

a second heating source providing heat for cooking foods in the second cooking chamber and independently operated from the first heating source;

a first duct including an upper duct and a lower duct in which exhaust gas generated during cooking foods in the first cooking chamber flows, the first duct having a length extending in a horizontal direction, the lower duct having an upper intake port and a communication hole;

a second duct in which exhaust gas generated during cooking foods in the second cooking chamber flows, the second duct having a length extending in the horizontal direction, the second duct being disposed at a rear side of the lower duct and being in contact with the lower duct in a front and rear direction;

a coupling device to couple the communication hole of the lower duct to the second duct; and a cylindrical connection member having a predetermined diameter, wherein the exhaust gas of the second cooking chamber flows into the second duct and is transferred to the upper duct, wherein the exhaust gas from the lower duct and the exhaust gas from the second duct are discharged to an outside of the main body after flowing through the upper duct, wherein the upper intake port and the communication hole are formed at opposed surfaces of the lower duct, wherein a first end of the cylindrical connection member communicates with the upper exhaust port of the first cavity and a second end of the cylindrical connection member communicates with the upper intake port of the lower duct, and wherein the cylindrical connection member maintains an interval between the first cavity and the first duct.

2. The cooker of claim 1, wherein the position where the exhaust gas of the second cooking chamber is transferred from the second duct to the first duct is higher than the position where the first duct receives the exhaust gas of the first cooking chamber.

3. The cooker of claim 2, wherein the position where the exhaust gas of the second cooking chamber flowing into the first and second ducts to the outside of the main body is higher than the position where the first duct receives the exhaust gas of the second cooking chamber flowing the second duct, the position where the first duct receives the exhaust gas of the first cooking chamber, and the position where the second duct receives the exhaust gas of the second cooking chamber.

4. A cooker, comprising:

a main body including a first cavity having a first cooking chamber and an upper exhaust port and a second cavity disposed at a lower side of the first cavity and having a second cooking chamber;

a first heating source providing heat for cooking foods in the first cooking chamber;

a second heating source providing heat for cooking foods in the second cooking chamber and independently operated from the first heating source;

a first duct having an upper duct and a lower duct in which first exhaust gas generated during cooking foods in the first cooking chamber flows, the lower duct having an upper intake port and a communication hole;

a second duct having a passage in which second exhaust gas generated during cooking foods in the second cooking chamber flows, at least one portion of the lower duct overlapping the second duct in a front and rear direction;

a coupling device to couple the at least one portion of the communication hole of the lower duct to the second duct; and a cylindrical connection member having a predetermined diameter, wherein the exhaust gas from the lower duct and the exhaust gas from the second duct are discharged to an outside of the main body after flowing through the upper duct, wherein the upper intake port and the communication hole are formed at opposed surfaces of the lower duct, wherein a first end of the cylindrical connection member communicates with the upper exhaust port of the first cavity and a second end of the cylindrical connection member communicates with the upper intake port of the lower duct, and wherein the cylindrical connection member maintains an interval between the first cavity and the first duct.

5. The cooker of claim 4, wherein the lower duct is disposed between the first cavity and the second duct.

6. The cooker of claim 4, wherein at least a portion of the second duct is disposed between the first cavity and the second cavity.

* * * * *